US005765791A

United States Patent [19]

Givonetti

[11] Patent Number: 5,765,791

[45] Date of Patent: Jun. 16, 1998

[54] HAND REST FOR AN EASEL

[76] Inventor: Raymond R. Givonetti, 808 Brixworth Blvd., Knoxville, Tenn. 37922

[21] Appl. No.: 789,793

[22] Filed: Jan. 29, 1997

[51] Int. Cl.[6] ..... A47B 97/04

[52] U.S. Cl. ..... 248/118; 248/118.5; 248/231.71; 248/279.1; 248/286.1; 248/291.1; 248/441.1; 248/540

[58] Field of Search ..... 248/540, 441.1, 248/118.5, 118, 231.71, 286.1, 279.1, 295.11, 291.1

[56] References Cited

U.S. PATENT DOCUMENTS

| | | | |
|---|---|---|---|
| 289,700 | 12/1883 | Parker . | |
| 2,516,759 | 7/1950 | Diderrich | 248/540 X |
| 3,643,902 | 2/1972 | Gualano | 248/231.71 X |
| 3,972,133 | 8/1976 | Parshall | 35/26 |
| 4,088,290 | 5/1978 | Novello | 248/118.5 |
| 4,188,006 | 2/1980 | Karlin | 248/118.3 |
| 4,685,644 | 8/1987 | Yates | 248/118.3 |
| 5,141,198 | 8/1992 | Hoyt | 248/441.1 |
| 5,172,883 | 12/1992 | Amirian | 248/441.1 |
| 5,193,772 | 3/1993 | Johnston | 248/118.5 |
| 5,281,001 | 1/1994 | Bergsten et al. | 248/118 X |
| 5,299,772 | 4/1994 | Weber | 248/441.1 |

*Primary Examiner*—Leslie A. Braun
*Assistant Examiner*—Donald J. Wallace
*Attorney, Agent, or Firm*—Pitts & Brittian, P.C.

[57] ABSTRACT

A hand rest for mounting on an easel, the hand rest being easily adjusted using only the artist's painting hand. The hand rest includes a cradle having a mounting block retainer and carrying a vise, a mounting cube, a rotating shaft carried by the mounting cube, a positioning assembly carried by the rotating shaft, a support shaft received within the positioning assembly, and a palm rest carried by the support shaft. The hand rest is designed such that the mounting cube may be received within the cradle in one of five orientations to facilitate mounting the hand rest in an equal number of positions on an easel. The rotating shaft is biased toward the mounting cube and bearing surface is disposed therebetween in order to make rotation of the rotation shaft difficult. However, when the artist pulls back on the support shaft, the rotating shaft is pulled away from the bearing surface and is then freely rotated. The positioner assembly is carried by the rotating shaft and includes a slotted opening and a position locking mechanism. Bearing surfaces are defined by the slotted opening to prevent the support shaft from rotating toward the canvas passed a position normal to the rotating shaft. Biasing members are provided for normally maintaining the orientation of the support shaft in a position normal to the rotating shaft. When the artist desires to move the support shaft within the slotted opening and to rotate the rotating shaft, the painting hand pulls the palm rest away from the canvas, thus allowing the rotating shaft to pivot with respect to the mounting cube and the support shaft to slide within the slotted opening.

11 Claims, 5 Drawing Sheets

HAND REST FOR AN EASEL

TECHNICAL FIELD

This invention relates to the field of artist tools. More specifically, the present invention relates to a device for steadying an artist's hand in front of a medium positioned on an easel or other drawing stand or table.

BACKGROUND ART

In the field of art, it is well known to use devices for steadying an artist's hand while at an easel. To this extent, many types of devices have been produced to perform such a function. Typical of the art are those devices disclosed in the following U.S. patents:

| Pat. No. | Inventor(s) | Issue Date |
|---|---|---|
| 289,700 | G. F. Parker | Dec. 4, 1883 |
| 3,972,133 | R. H. Parshall | Aug. 3, 1976 |
| 4,088,290 | L. J. Novello | May 9, 1978 |
| 4,188,006 | R. Karlin | Feb. 12, 1980 |
| 4,685,644 | R. E. Yates | Aug. 11, 1987 |
| 5,141,198 | M. E. Hoyt | Aug. 25, 1992 |
| 5,172,883 | A. J. Amirian | Dec. 22, 1992 |
| 5,193,772 | W. G. Johnston | Mar. 16, 1993 |
| 5,299,772 | M. S. Weber | Apr. 5, 1994 |

One conventional device is known in the art as a maul stick. Such a device is defined by an elongated member carried at one end by the easel or the medium. The opposite end is either supported by the artist's free hand or supported by the easel. In either case, the maul stick is conventionally capable of being freely movable such that as the position of the artist's hand varies, the maul stick may be accordingly moved. Several of the devices cited above disclose variations of a maul stick. Parker ('700) discloses a maul stick secured to an easel such that the first end may undergo lateral displacement. On the second end of the maul stick is carried a pallet. Centrally disposed along the maul stick is an adjustable hand rest. The hand rest may be slid along the length of the maul stick and tightened into place. Yates ('644) and Hoyt ('198) disclose maul sticks for steadying the hand of an artist similar to that of Parker.

Parshall ('133) discloses a maul stick which may be engaged at one end within one of several discrete receptors disposed along one side of an artist's frame. The free end is held by the user's free hand while the hand used to paint rests upon the stick.

Novello ('290) discloses a maul stick having an adjustable length, and which is either engaged at each end to the work surface or the medium, or one end is so engaged and the other end is held by the painter in one hand. The maul stick is fabricated from two telescoping members which allow for the length of the maul stick to be adjusted.

Those devices disclosed by Karlin ('006), Amirian ('883) and Johnston ('772) are similar to conventional X-Y tables having a horizontal support which may be vertically adjusted, or vice versa. Each of these devices, and especially the latter two, is designed such that it may be used on only one type and or size of easel. These devices cannot be easily removed from the easel and then placed on another easel of a different size and construction.

The device disclosed by Weber ('772) is similar to the previously described maul stick-type devices, with a hand bridge pivotally mounted on the frame of a canvas. A coupler is carried by a clamp, the coupler being configured to allow the hand bridge to swing one hundred eighty degrees (180°). However, the hand bridge may only be disposed in three orientations with respect to the clamp. Further, the distal end of the hand bridge must be supported by the canvas.

Although maul sticks are widely know, there are several problems inherent in their use. First, one end of the maul stick rests on the media which may damage the artwork especially for long drying time oils. Second, the non-painting hand is used to support the maulstick precluding the use of a pallet, which is addressed in those maul stick-type devices designed to also carry a pallet. Third, because one end of the maul stick is held by the non-painting hand, movement of the maul stick, and therefore movement of the painting hand, is commonplace.

Therefore, it is an object of this invention to provide a hand rest for being mounted on an easel without restricting the changing or moving of the artist's frame or canvas, thus allowing the hand rest to remain mounted on the easel independently from the frame or canvas.

It is also an object of the present invention to provide a hand rest which is retractable from the frame or canvas without requiring dismounting thereof.

Another object of the present invention is to provide a hand rest which may be easily adjusted with respect to the artist's frame or canvas using only the artist's painting hand, and which may be locked in position by engagement with the painting hand.

Still another object of the present invention is to provide a hand rest having a palm support providing greater stability over devices of the prior art.

DISCLOSURE OF THE INVENTION

Other objects and advantages will be accomplished by the present invention which is designed to be mounted on an easel without restricting the changing or moving of the artist's frame or canvas, thus allowing the hand rest to remain mounted on the easel independently from the frame or canvas while providing a hand rest having a palm support providing greater stability over devices of the prior art. Moreover, the hand rest of the present invention is designed to be retractable from the frame or canvas without requiring dismounting thereof. The hand rest is easily adjusted with respect to the artist's frame or canvas using the artist's painting hand, and is locked in position by engagement with the painting hand.

The hand rest includes a cradle having a mounting block retainer and carrying a vise, a mounting cube carried by the cradle and used in conjunction with the vise, a rotating shaft carried by the mounting cube, a positioning assembly carried by the rotating shaft, a support shaft received within the positioning assembly, and a palm rest carried by the support shaft. The hand rest is designed such that the mounting cube may be received within the cradle in one of five orientations to facilitate mounting the hand rest in an equal number of positions on an easel. By mounting the hand rest in various positions, various types of easels and various mounting requirements of an artist are accommodated.

The cradle is configured at the first end to receive the mounting cube in a selected orientation. The cradle includes a bottom member upon which the mounting cube is placed. An end retainer is carried by the cradle first end for limiting axial movement of the mounting cube. To limit lateral movement of the mounting cube, stops are carried on either side of the bottom member and at the top of the end retainer. In order to facilitate placement of the mounting cube in various orientations, the stops are configured such as to not interfere with the rotating shaft. The end retainer is also configured to receive the rotating shaft. The bottom member defines an opening for receipt of the rotating shaft as well. Thus, the mounting cube may be oriented such that the rotating shaft may extend up, down, left, right, or forward from the cradle.

A vise is defined between the mounting block and the second end of the cradle. To facilitate mounting of the hand rest onto an easel, a threaded member having an engagement foot carried on a distal end thereof is received on an end wall, the threaded member being oriented such that the engagement surface of the engagement foot is parallel to the rear face of the mounting cube. The cradle is positioned such that a portion of the easel is received between the engagement surface of the engagement foot and the rear face of the mounting cube. The threaded member is then engaged to move the engagement foot toward the mounting cube until the easel is firmly grasped.

A rotating shaft is rotatably mounted to the mounting cube and is provided for carrying the support shaft. A bearing surface is disposed between the rotating shaft and the mounting cube. A compression spring is disposed between the mounting cube and a washer in order to bias the rotating shaft toward the mounting cube. By mounting the rotating shaft to the mounting cube in this fashion, rotation of the rotation shaft is made difficult. However, when the artist pulls back on the support shaft, the rotating shaft is pulled away from the bearing surface and is then freely rotated.

The positioner assembly is carried by the rotating shaft and includes a slotted opening defined by the rotating shaft and a position locking mechanism. At one end of the forward face and the opposite end of the rearward face of the slotted opening, a bearing surface is configured to prevent the support shaft from rotating toward the canvas passed a position normal to the rotating shaft. On opposite ends from the bearing surfaces, each of the forward and rearward faces carries a biasing member for normally maintaining the orientation of the support shaft in a position normal to the rotating shaft. In the preferred embodiment, the biasing members are spring loaded. When no force is exerted on the support shaft, the support shaft is prevented from moving. When the artist place's a hand on the hand rest, pressure is placed on each of the bearing surfaces defined within the slotted opening, thereby further preventing the support shaft from moving. However, when the artist desires to move the support shaft within the slotted opening, the painting hand is used to grasp the palm rest and pulls away from the canvas. The engagement between the support shaft and the bearing surfaces is thus broken and the support shaft is adjusted. Also, when the palm rest is pulled away from the canvas, the rotating shaft is pulled away from the bearing surface and is then freely rotated. When the desired position of the palm rest is achieved, the artist releases the palm rest and the position is locked. The palm rest is carried at the distal end of the support shaft and is disc-shaped for easy engagement by the palm of an artist.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

A hand rest for an easel incorporating various features of the present invention is illustrated generally at 10 in the figures. The hand rest for an easel, or hand rest 10, is designed for being mounted on an easel 120 without restricting the changing or moving of the artist's frame or canvas 122, thus allowing the hand rest 10 to remain mounted on the easel 120 independently from the frame or canvas 122 while providing a hand rest 10 having a palm support 100 providing greater stability over devices of the prior art. Moreover, the hand rest 10 of the present invention is designed to be retractable from the frame or canvas 122 without requiring dismounting thereof The hand rest 10 is easily adjusted with respect to the artist's frame or canvas 122 using the artist's painting hand, and is locked in position by engagement with the painting hand. Although this disclosure speaks of a canvas 122, it will be understood that due to the manner in which the present invention is mounted on an easel 120, the present invention may be used while painting on any medium, without risking damage to the medium or to the work itself.

Figure 1:
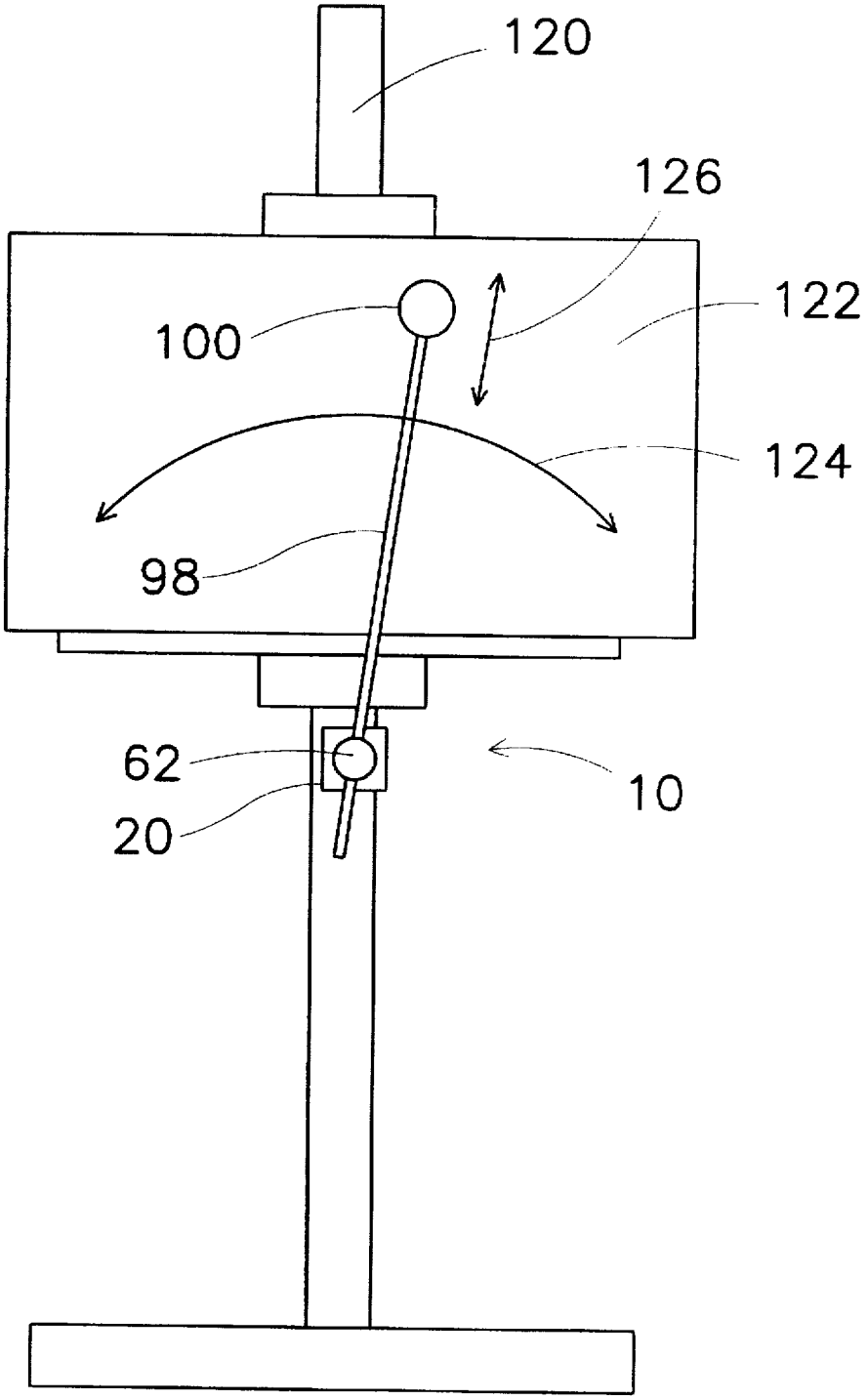
FIG. 1 is a front elevation view of the hand rest for an easel constructed in accordance with several features of the present invention and shown mounted on a conventional easel.
Figure 2:
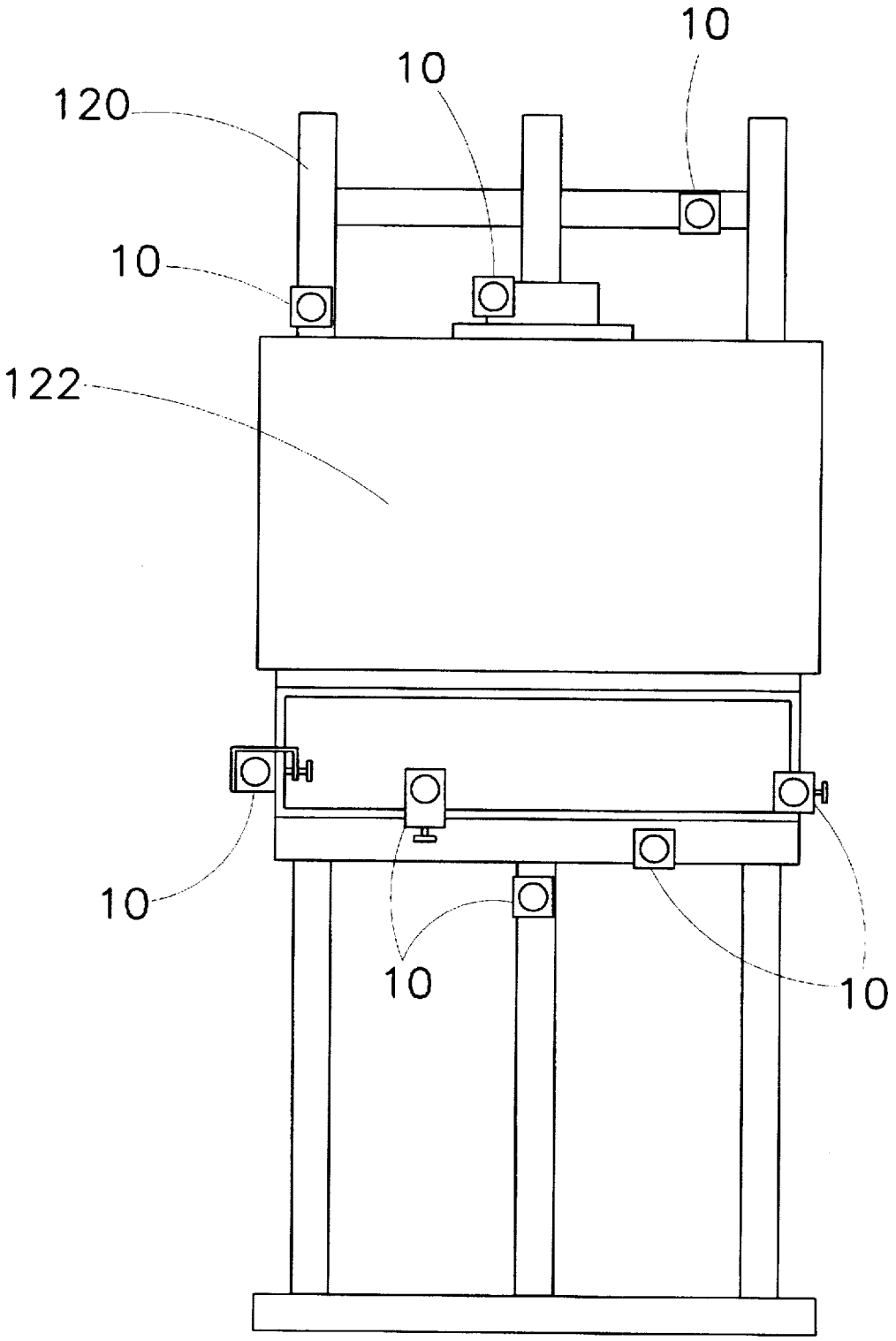
FIG. 2 illustrates a front elevation view of a conventional easel showing a plurality of mounting locations and orientations of the hand rest of the present invention.

The hand rest 10 is primarily comprised of a cradle 12 carrying a vise 44, a mounting cube 28 carried by the cradle 12 and used in conjunction with the vise 44, a rotating shaft 62 carried by the mounting cube 28, a positioning assembly 94 carried by the rotating shaft 62, a support shaft 98 received within the positioning assembly 94, and a palm rest 100 carried by the support shaft 98. FIG. 1 illustrates one position in which the hand rest 10 may be mounted on an easel 120. In this example, the cradle 12 is mounted on a support below a canvas 122. As illustrated by the arrow 124, the support shaft 98 may be pivoted about the axis of the rotating shaft 62, and may be slid as indicated by the arrow 126 within the positioning assembly 94. Thus, the palm rest 100 may be positioned at any location above the canvas 122. FIG. 2 illustrates a number of positions at which the hand rest 10 may be disposed. In order to avoid confusion in the drawing, the support shaft 98 has not been illustrated. However, in each disposition of the cradle 12 and vise 44, the mounting cube 28 is oriented such that the rotating shaft 62 is oriented perpendicular to the canvas 122 and toward the artist, with the support shaft 98 having the same degrees of freedom as illustrated in FIG. 1. The specific details of a preferred embodiment of the individual components follows with the description of FIGS. 3–5.

Figure 3:
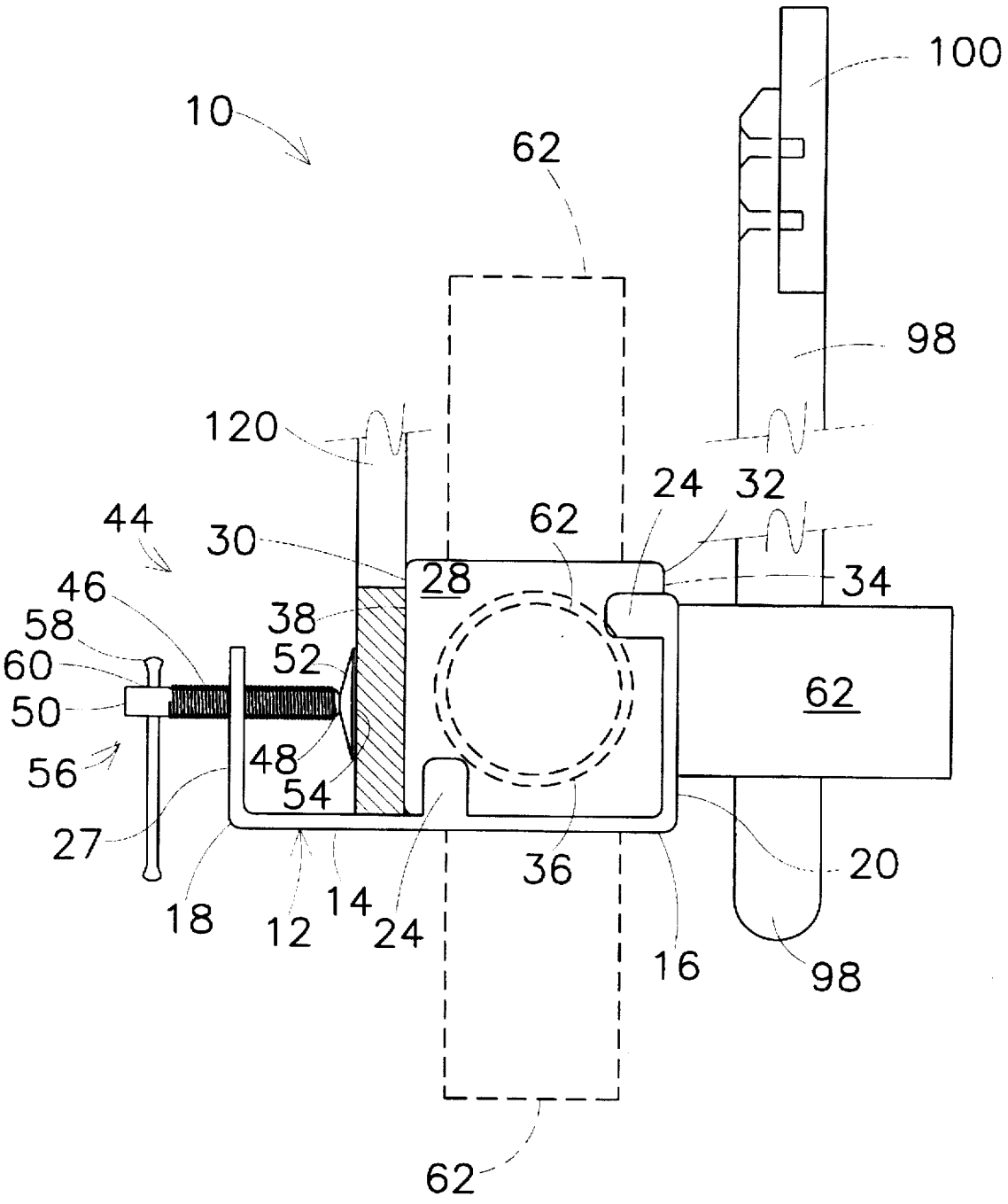
FIG. 3 is a side elevation view of the hand rest of the present invention, illustrating in phantom several alternate orientations of the mounting cube and support shaft with respect to the cradle.
Figure 4:
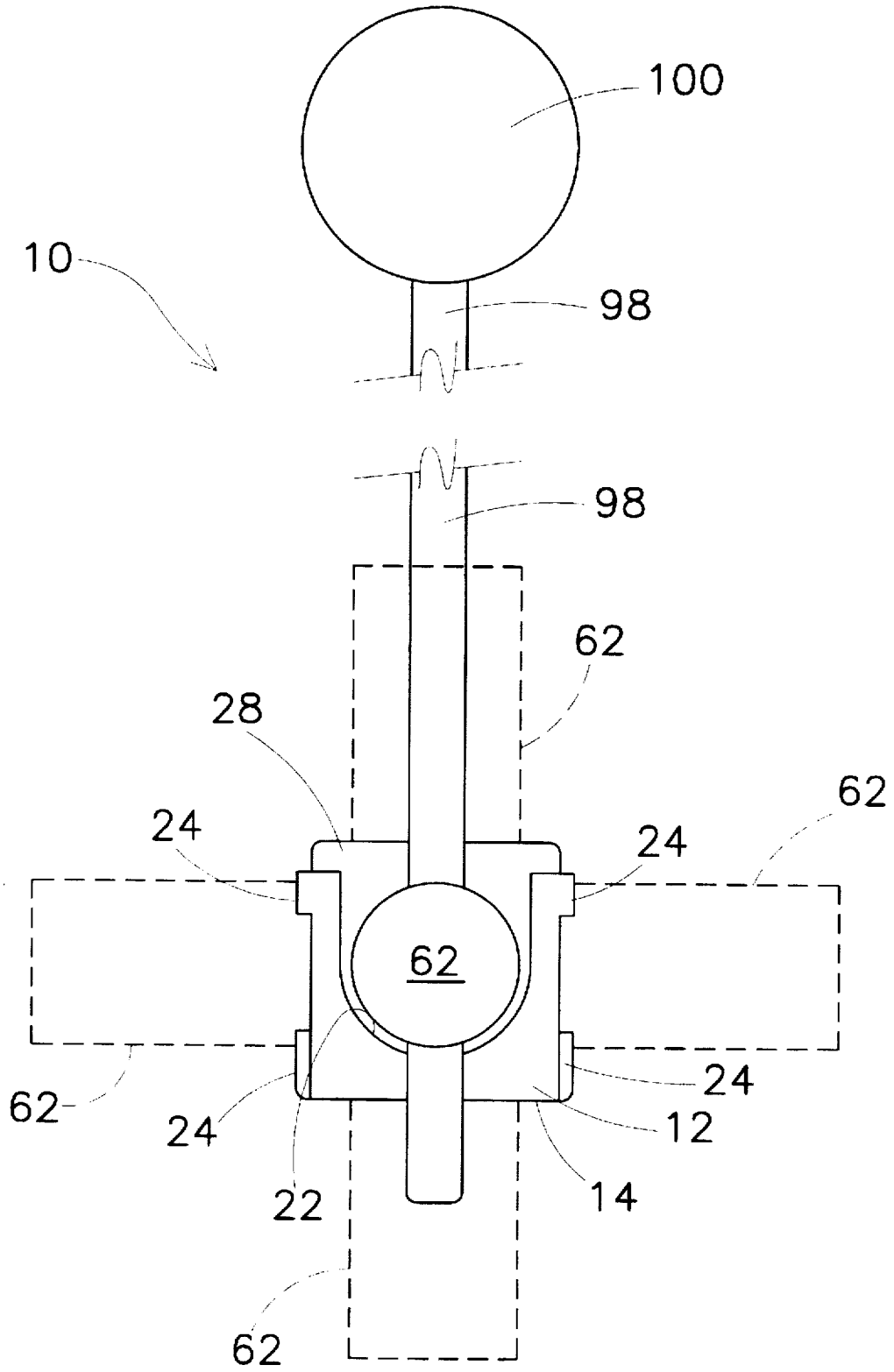
FIG. 4 is an end elevation of the hand rest further illustrating the alternate orientations of the mounting block.

As illustrated in FIG. 3, the cradle 12 is configured at the first end 16 to receive the mounting cube 28 in a selected orientation. To this extent, the cradle 12 includes a bottom member 14 upon which the mounting cube 28 is placed. An end retainer 20 is carried by the cradle first end 16 for limiting axial movement of the mounting cube 28. To limit lateral movement of the mounting cube 28, stops 24 are carried on either side of the bottom member 14 and at the top of the end retainer 20. The stops 24 further prevent the mounting cube 28 from rotating within the cradle 12. In order to facilitate placement of the mounting cube 28 in various orientations, the stops 24 are configured such as to not interfere with the rotating shaft 62, as described below. Further, the end retainer 20 is configured to receive the rotating shaft 62. As illustrated more clearly in FIG. 4, the end retainer 20 defines a "U"-shaped notch 22 for receipt of the rotating shaft 62. Finally, as illustrated with hidden lines, the bottom member 14 defines an opening 26 for receipt of the rotating shaft 62. Thus, the mounting cube 28 may be oriented such that the rotating shaft 62 may extend up, down, left, right, or forward from the cradle. This variety of orientations is more clearly illustrated in FIG. 4, with the upward orientation of the rotating shaft 62 being shown with object lines, and the remaining orientations being illustrated with broken lines. Therefore, the cradle 12 may be mounted in one of five different orientations to allow for various configurations of easels 120, and to mount the cradle 12 in one of various positions on one easel 120, to suit the needs of the artist.

A vise 44 is defined between the mounting block 28 and the second end 18 of the cradle 12. To facilitate mounting of the hand rest 10 onto an easel 120, a threaded member 46 having an engagement foot 52 carried on a distal end 48 thereof is received on an end wall 27, the threaded member 46 being oriented such that the engagement surface 54 of the engagement foot 52 is parallel to the rear face 30 of the mounting cube 28. To this extent, the rear face 30 of the mounting cube 28 is that face opposite the face 32 engaged by the end retainer 20. Thus, the cradle 12 is positioned such that a portion of the easel 120 is received between the engagement surface 54 of the engagement foot 52 and the rear face 30 of the mounting cube 28. The threaded member 46 is then engaged to move the engagement foot 52 toward the mounting cube 28 until the easel 120 is firmly grasped. It will be seen that when the hand rest 10 is mounted in this way, the vise 44 not only serves to hold the hand rest 10 onto the easel 120, but it also serves to retain the mounting cube 28. In order to facilitate rotation of the threaded member 46, a gripping device 56 is carried by the proximal end 50 thereof. On the illustrated embodiment, the gripping device 56 is a sliding rod 58 received within an opening 60 defined by the proximal end 50 of the threaded member 46. However, it is envisioned that a knob or other conventional gripping device may be incorporated as well with similar results.

The cradle 12 may be fabricated from various materials. However, in the preferred embodiment, the cradle 12 is manufactured from a stamped metal, with the end retainer 20, stops 24 and the end wall 27 defined at the second end 18 being formed by bending. By fabricating the cradle 12 from stamped metal, fabrication costs are substantially lower as compared to fabricating the cradle 12 from other materials. Other materials from which the cradle 12 may be manufactured include, but are not limited to, injection molded or spun molded plastics, and wood. Of course, depending upon the material and method of manufacturing, the specific configuration of the cradle 12 may vary from that disclosed. Therefore, this disclosure is not intended to limit the present invention to that described and depicted in the figures.

Figure 5:
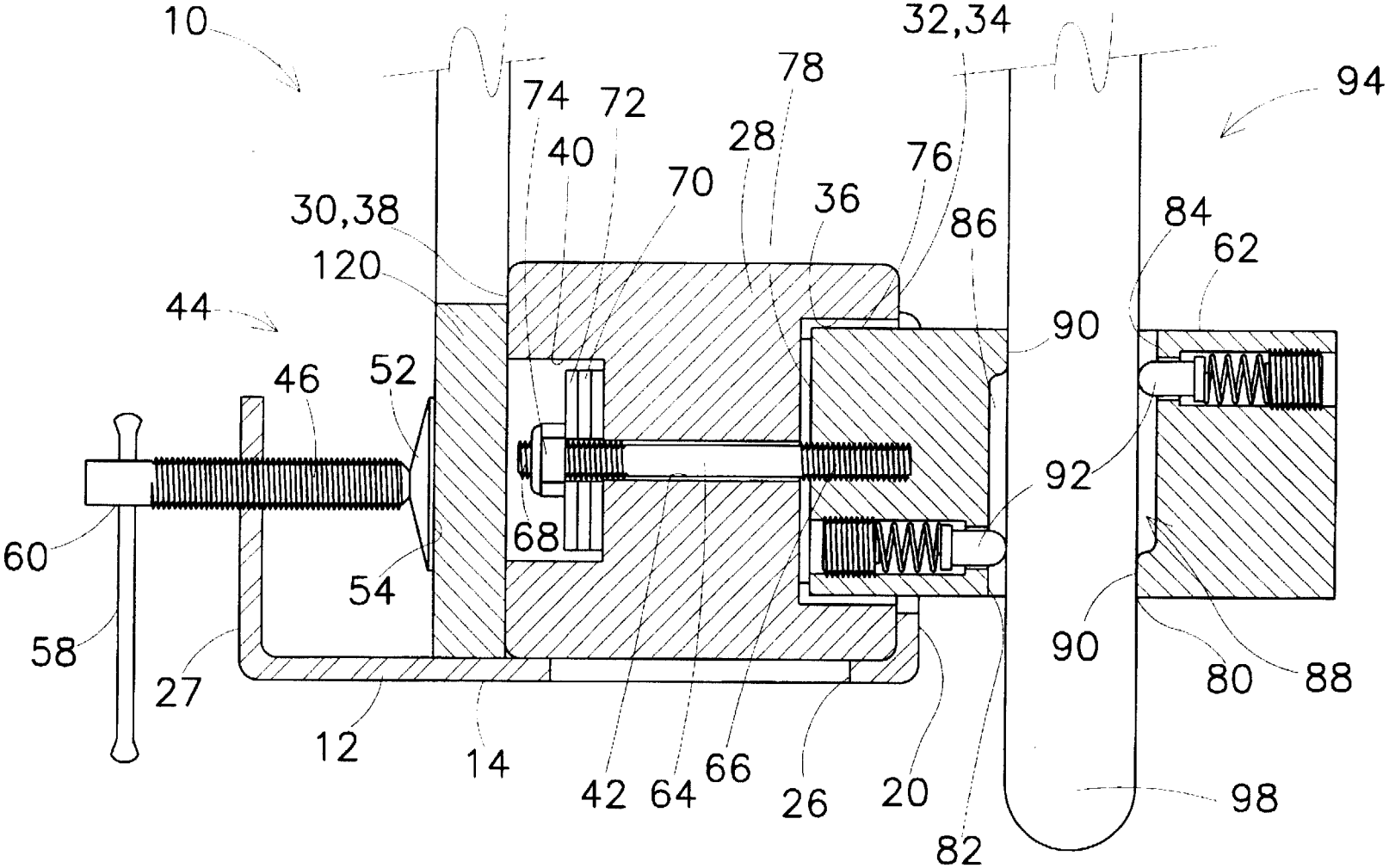
FIG. 5 an elevation view, in section, of the hand rest of the present invention taken at 5—5 of FIG. 4.

A rotating shaft 62 is carried by the mounting cube 28 for carrying the support shaft 98. As best illustrated in FIG. 5, the rotating shaft 62 is journaled to the mounting cube 28 via a bolt 64. One end 66 of the bolt 64 is received within the rotating shaft 62, with the opposite end 68 being received through the mounting cube 28. A through opening 42 is defined by the mounting cube 28 and is dimensioned to allow rotation of the bolt 64 therein. A first recess 36 is defined on a first face 34 of the mounting cube 28 for receipt of the proximal end 76 of the rotating shaft 62. A bearing surface 78 is disposed between the rotating shaft 62 and the first recess 36 defined by the mounting cube 28. A second face 38 of the mounting cube 28, opposite the first mounting cube face 34, defines a second recess 40 for receipt of the opposite end 68 of the bolt 64. A compression spring 70 is disposed between the mounting cube 28 and a washer 72 in order to bias the rotating shaft 62 toward the mounting cube 28. A locking nut 74 is provided for tightening the assembly. As illustrated, the opposite end 68 of the bolt 64, the spring 70, the washer 72 and the nut 74 are each received within the second recess 40 such that the mounting cube 28 may be oriented where the second face 38 is also the rear face 30. By mounting the rotating shaft 62 to the mounting cube 28 in this fashion, rotation of the rotating shaft 62 is made difficult. However, as will be described below, when the artist pulls back on the support shaft 98, the rotating shaft 62 is pulled away from the bearing surface 78 and is then freely rotated.

The positioner assembly 94 is carried by the rotating shaft 62. Referring to FIG. 5, the positioner assembly 94 includes a slotted opening 80 defined by the rotating shaft 62 and a position locking mechanism 96. The slotted opening 80 defines a forward face 82, a rearward face 84, and two sides 86. The sides 86 are spaced apart to loosely receive the support shaft 98 to allow the support shaft 98 to slide, yet narrowly enough to prevent lateral rotation of the support shaft 98 with respect to the rotating shaft 62. The forward and rearward faces 82,84 of the slotted opening 80 are spaced apart to define a gap 88 between each and the respective sides of the support shaft 98. At one end of the forward face 82 and the opposite end of the rearward face 84, a bearing surface 90 is configured to prevent the support shaft 98 from rotating toward the canvas 122 past a position normal to the rotating shaft 62. On opposite ends from the bearing surfaces 90, each of the forward and rearward faces 82,84 carries a biasing member 92 for normally maintaining the orientation of the support shaft 98 in a position normal to the rotating shaft 62. In the preferred embodiment, the biasing members 92 are spring loaded. When no force is exerted on the support shaft 98, the support shaft 98 is prevented from moving. When the artist places a hand on the hand rest 10, pressure is placed on each of the bearing surfaces 90 defined within the slotted opening 80, thereby further preventing the support shaft 98 from moving. However, when the artist desires to move the support shaft 98 within the slotted opening 80, the painting hand is used to grasp the palm rest 100 and pull the palm rest 100 away from the canvas 122. The engagement between the support shaft 98 and the bearing surfaces 90 is thus broken and the support shaft 98 is adjusted. Also, as described above, when the palm rest 100 is pulled away from the canvas 122, the rotating shaft 62 is pulled away from the bearing surface 78 and is then freely rotated. When the desired position of the palm rest 100 is achieved, the artist releases the palm rest 100 and the position is locked.

To this extent, the palm rest 100 is carried at the distal end of the support shaft 98. The palm rest 100 of the illustrated embodiment is disc-shaped for easy engagement by the palm of an artist. The palm rest 10 is secured to the support shaft 98 in a conventional fashion such as with glue, screw-type fasteners, or nails.

From the foregoing description, it will be recognized by those skilled in the art that a hand rest for an easel offering advantages over the prior art has been provided. Specifically, the hand rest is provided for being mounted on an easel without restricting the changing or moving of the artist's frame or canvas, thus allowing the hand rest to remain mounted on the easel independently from the frame or canvas while providing a hand rest having a palm support providing greater stability over devices of the prior art. Moreover, the hand rest of the present invention is retractable from the frame or canvas without requiring dismounting thereof. The hand rest is easily adjusted with respect to the artist's frame or canvas using the artist's painting hand, and is locked in position by engagement with the painting hand.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A hand rest for mounting on an easel, said hand rest comprising:

a cradle for mounting on an easel, said cradle defining a bottom member carrying an end retainer at a first end thereof and lateral retainers on a first side and a second side thereof, a mounting cube carried by said cradle and dimensioned to be closely received between said end retainer and said lateral retainers, said mounting cube defining six substantially equal sides, and including at least, a first side and a second side defined by a construction of said mounting cube and a front side and a rear side defined by an orientation of said mounting cube with respect to said cradle;

a vise carried by a second end of said cradle and used in conjunction with said rear side of said mounting cube, said cradle being positioned such that said vise and said mounting cube rear side are spaced apart for receiving the easel at a selected location, said vise being engaged to secure said hand rest on the easel and further to retain said mounting cube in said cradle;

a rotating shaft carried by said mounting cube first side;

a positioning assembly carried by said rotating shaft, said positioning assembly including a slotted opening defined by said rotating shaft;

a support shaft received within said positioning assembly slotted opening; and a palm rest carried by said support shaft at a distal end thereof.

2. The hand rest of claim 1 wherein said cradle lateral retainers each define at least one stop carried on either side of said bottom member and at a top end of said end retainer.

3. The hand rest of claim 1 wherein said bottom member, said end retainer and said lateral retainers are each configured to receive said rotating shaft in order to facilitate orientation of said mounting cube in one of five orientations.

4. The hand rest of claim 1 wherein said vise includes a threaded member having an engagement foot carried on a distal end thereof, said threaded member being received on an end wall of said bottom member, said threaded member being oriented such that an engagement surface of said engagement foot is parallel to said mounting cube rear side.

5. The hand rest of claim 1 wherein said rotating shaft is rotatably mounted on said mounting cube, said mounting cube defining a through opening to receive a bolt, said bolt being secured at one end to said rotating shaft, a biasing device being provided to bias said rotating shaft toward said mounting cube, a bearing surface being disposed between said rotating shaft and said mounting cube to prevent rotation of said rotating shaft until said palm rest is engaged and pulled away from the easel, thus breaking contact between said rotating shaft and said bearing surface.

6. The hand rest of claim 1 wherein said positioner assembly further includes a bearing surface at one end of a forward face and an opposite end of a rearward face and a biasing member at said opposite end of said forward face and at said one end of said rearward face for maintaining an orientation of said support shaft in a position normal to said rotating shaft.

7. The hand rest of claim 1 wherein said support shaft defines an elongated configuration, and wherein said palm rest defines a disc-shaped configuration.

8. A hand rest for mounting on an easel, said hand rest comprising:

a cradle for mounting on an easel, said cradle defining bottom member carrying an end retainer at a first end thereof and lateral retainers on a first side and a second side thereof;

a mounting cube carried by said cradle and dimensioned to be closely received between said end retainer and said lateral retainers, said mounting cube defining six substantially equal sides, and including at least, a first side and a second side defined by a construction of said mounting cube and a front side and a rear side defined by an orientation of said mounting cube with respect to said cradle;

a vise carried by a second end of said cradle and used in conjunction with said rear side of said mounting cube, said cradle being positioned such that said vise and said mounting cube rear side are spaced apart for receiving the easel at a selected location, said vise being engaged to secure said hand rest on the easel and further to retain said mounting cube in said cradle, said vise including a threaded member having an engagement foot carried on a distal end thereof, said threaded member being received on an end wall of said bottom member, said threaded member being oriented such that an engagement surface of said engagement foot is parallel to said mounting cube rear side;

a rotating shaft carried by said mounting cube first side, said cradle bottom member, said rotating shaft being rotatably mounted on said mounting cube, said mounting cube defining a through opening to receive a bolt, said bolt being secured at one end to said rotating shaft, a biasing device being provided to bias said rotating shaft toward said mounting cube, a bearing surface being disposed between said rotating shaft and said mounting cube to prevent rotation of said rotating shaft, said end retainer and said lateral retainers each being configured to receive said rotating shaft in order to facilitate orientation of said mounting cube in one of five orientations;

a positioning assembly carried by said rotating shaft, said positioning assembly including a slotted opening defined by said rotating shaft, a bearing surface at one end of a forward face and an opposite end of a rearward face and a biasing member at said opposite end of said forward face and at said one end of said rearward face for maintaining an orientation of a support shaft in a position normal to said rotating shaft;

said support shaft being received within said positioning assembly slotted opening; and a palm rest carried by said support shaft at a distal end thereof.

9. The hand rest of claim 8 wherein said cradle lateral retainers each define at least one stop carried on either side of said bottom member and at a top end of said end retainer.

10. The hand rest of claim 8 wherein said support shaft defines an elongated configuration, and wherein said palm rest defines a disc-shaped configuration.

11. A hand rest for mounting on an easel, said hand rest comprising:

a cradle for mounting on an easel, said cradle defining a bottom member carrying an end retainer at a first end thereof and lateral retainers on a first side and a second side thereof, said lateral retainers each defining at least one stop carried on either side of said bottom member and at a top end of said end retainer;

a mounting cube carried by said cradle and dimensioned to be closely received between said end retainer and said lateral retainers, said mounting cube defining six substantially equal sides, and including at least, a first side and a second side defined by a construction of said mounting cube and a front side and a rear side defined by an orientation of said mounting cube with respect to said cradle, a vise carried by a second end of said cradle and used in conjunction with said rear side of said mounting cube, said cradle being positioned such that said vise and said mounting cube rear side are spaced apart for receiving the easel at a selected location, said vise being engaged to secure said hand rest on the easel and further to retain said mounting cube in said cradle, said vise including a threaded member having an engagement foot carried on a distal end thereof, said threaded member being received on an end wall of said bottom member, said threaded member being oriented such that an engagement surface of said engagement foot is parallel to said mounting cube rear side;

a rotating shaft carried by said mounting cube first side, said cradle bottom member, said rotating shaft being rotatably mounted on said mounting cube, said mounting cube defining a through opening to receive a bolt, said bolt being secured at one end to said rotating shaft, a biasing device being provided to bias said rotating shaft toward said mounting cube, a bearing surface being disposed between said rotating shaft and said mounting cube to prevent rotation of said rotating shaft, said end retainer and said lateral retainers each being configured to receive said rotating shaft in order to facilitate orientation of said mounting cube in one of five orientations, a positioning assembly carried by said rotating shaft, said positioning assembly including a slotted opening defined by said rotating shaft, a bearing surface at one end of a forward face and an opposite end of a rearward face and a biasing member at said opposite end of said forward face and at said one end of said rearward face for maintaining an orientation of a support shaft in a position normal to said rotating shaft;

said support shaft defining an elongate configuration and being received within said positioning assembly slotted opening, and a palm rest carried by said support shaft at a distal end thereof, said palm rest defining a disc-shaped configuration.

* * * * *